US006874620B2

(12) United States Patent
Mattson et al.

(10) Patent No.: US 6,874,620 B2
(45) Date of Patent: Apr. 5, 2005

(54) CONTAINER CARRIER

(75) Inventors: Larry J. Mattson, Charlotte, NC (US); James H. Sewell, Concord, NC (US)

(73) Assignee: Roberts Polypro, Charlotte, NC (US)

( * ) Notice: Subject to any disclaimer, the term of this patent is extended or adjusted under 35 U.S.C. 154(b) by 108 days.

(21) Appl. No.: 10/340,465

(22) Filed: Jan. 10, 2003

(65) Prior Publication Data

US 2004/0134799 A1 Jul. 15, 2004

(51) Int. Cl.[7] ..... B65D 5/42
(52) U.S. Cl. ..... 206/151; 206/148; 294/87.2
(58) Field of Search ..... 493/56, 227; 294/87.2, 294/87.28; 206/427, 428, 151, 152, 153, 159, 199

(56) References Cited

U.S. PATENT DOCUMENTS

| | | | | | |
|---|---|---|---|---|---|
| 3,269,530 | A | * | 8/1966 | Wanderer | 206/150 |
| 3,830,361 | A | * | 8/1974 | Klygis | 206/150 |
| 4,109,787 | A | * | 8/1978 | Klygis et al. | 206/150 |
| 4,247,142 | A | | 1/1981 | Erickson | 294/87.2 |
| 4,448,452 | A | | 5/1984 | Wood | 294/87.2 |
| 4,487,312 | A | | 12/1984 | Heider | 206/158 |
| 4,681,004 | A | | 7/1987 | Waldner | 83/98 |
| 4,811,861 | A | | 3/1989 | Roberts | 221/197 |
| 4,822,656 | A | | 4/1989 | Hutter, III | 428/40 |
| 4,946,536 | A | | 8/1990 | Roberts | 156/272.2 |
| 5,052,992 | A | | 10/1991 | Hyder | 493/62 |
| 5,306,060 | A | | 4/1994 | Borg | 294/87.2 |
| 5,467,915 | A | | 11/1995 | Mattson | 229/117.24 |
| RE35,288 | E | | 7/1996 | Borg | 294/87.2 |
| 5,624,012 | A | | 4/1997 | Wang | 190/115 |
| 5,735,562 | A | | 4/1998 | Borg | 294/87.2 |
| 5,736,217 | A | | 4/1998 | Banfield et al. | 428/100 |
| 5,782,325 | A | | 7/1998 | O'Shea et al. | 190/18 A |
| 6,027,773 | A | | 2/2000 | Sterr et al. | 428/7 |
| 6,047,798 | A | | 4/2000 | Lin | 190/18 A |
| 6,070,888 | A | | 6/2000 | Wang | 280/37 |
| 6,129,397 | A | | 10/2000 | Borg | 294/87.2 |
| 6,179,101 | B1 | | 1/2001 | Lin | 190/103 |
| 6,196,366 | B1 | | 3/2001 | Lin | 190/18 A |
| 6,378,764 | B1 | | 4/2002 | Teixidor Casanovas | 229/191 |
| 6,409,871 | B1 | | 6/2002 | Washburn et al. | 156/256 |
| 6,418,606 | B1 | | 7/2002 | Bachand | 29/412 |

* cited by examiner

*Primary Examiner*—Jacob K. Ackun, Jr.
(74) *Attorney, Agent, or Firm*—Moore & Van Allen PLLC; Michael G. Johnston; Jerry W. Clark

(57) ABSTRACT

A container carrier is provided for use with a plurality of containers. The container carrier comprises a substantially planar flexible platform having a top, a bottom, an outer perimeter and an inner region including a handle and a plurality of container-engaging portions. The handle is made by forming two generally triangularly shaped openings through the sheet on opposite sides of and equally distant from the central axis of the sheet, the material between the openings comprising a strap. Two inwardly opening U-shaped openings are formed around the ends of the strap such that the central axis of the sheet is the line of symmetry of the U-shaped openings. The portion of the sheet bordered by the U-shaped openings comprises a first hinge and a second hinge integral with the first end and second end of the strap, respectively, which permit the strap to be flexed upwardly above the plane of the platform and provide access to the strap. A plurality of container-engaging portions integral with the inner region of the platform are provided. Each container-engaging portion defines an opening through the platform and has a plurality of spaced notches extending radially outwardly of the perimeter of the container-engaging opening forming a plurality of collars for releasably engaging the containers.

24 Claims, 4 Drawing Sheets

CONTAINER CARRIER

BACKGROUND

This invention relates generally to a carrier for transporting a plurality of containers, such as bottles, and more particularly to a container carrier having a handle that facilitates the use, transportation and storage of the carrier and the associated containers.

Carriers that package a plurality of containers by their necks and allow the containers to be carried are well known. The carriers are often plastic ring carriers, commonly called "six-pack" rings, which unitize a plurality of like-sized containers into a single package. These types of carriers are commonly fabricated from flat, thin gauge sheets of plastic. Holes through the middle portions of these carriers typically serve as means for grasping the carrier. Although these carriers allow for containers to be efficiently packaged, a significant drawback of these carriers is that they can be difficult and uncomfortable to carry due to the use of holes through thin gauge plastic as the carrying mechanism. This is particularly the case when used with heavy or large containers.

The problems with six-pack rings have been mitigated somewhat by the use of injection molded plastic carriers that have support ribs to provide support for lifting and carrying the carriers. This problem has also been addressed by the addition of fixed rigid handles to carriers and the use of paperboard box carriers with integrated fixed handles.

Although injection molded plastic carriers and fixed handle carriers facilitate the use of the carriers, the support ribs and fixed handles complicate the storage of these carriers. The support ribs on the injection-molded carriers make such carriers difficult to stack and store prior to being installed onto containers, and difficult to install efficiently and uniformly. Fixed handle carriers and paperboard box carriers with integrated fixed handles suffer from similar disadvantages because the fixed handles typically protrude from the carrier. As a result, the packaged containers cannot be stacked on top of each other and, thus, additional storage space is required.

A further drawback of many of the currently available container carriers is that once the containers are removed from the carriers, the carriers are not easily reused. The traditional plastic ring carriers are often damaged or ripped upon removal of the containers due to the thin gauge of the plastic. Fully enclosed paperboard box carriers that utilize punch out handles are usually torn open for removal of the containers. Moreover, for other carriers with handles that actually have a compact shipping profile, once the handles are engaged for use, the handle typically creates a raised package profile which does not easily resume its former compact configuration.

A handle disclosed in U.S. Pat. No. 5,467,915 to Mattson, the contents of which are hereby incorporated by reference in their entirety, is capable of maintaining a substantially flat profile after repeated use. The Mattson handle, however, is designed primarily to be used in connection with individual containers, paperboard box carriers and the like. Moreover, although the Mattson handle addresses the problem it was designed to solve, the Mattson handle is made by cutting score lines ending in circular apertures, which is an inefficient manufacturing method and makes it difficult for the Mattson handle to be integrated into a container carrier that packages a plurality of containers by their necks.

For the foregoing reasons, there is a need for a container carrier that is easy to use, even when packing and transporting large or heavy containers. The new container carrier should have a substantially flat profile when not in use, allow for a plurality of containers to be compactly packaged and easily stored and stacked, and maintain its initial form after repeated use. Ideally, the design of the carrier is one that can be efficiently manufactured and that allows for uniform and high speed installation of the carrier on containers.

SUMMARY

According to the present invention, a handle is provided for a container carrier including a substantially planar flexible platform having a top, a bottom, an outer perimeter and an inner region having a plurality of container-engaging portions formed therein. The handle comprises a strap having a first strap end and a second strap end, and first and second hinges adapted to be integral with the platform. The strap is connected at the first strap end by the first hinge and at the second strap end by the second hinge. Each of the strap and first and second hinges are adjacent to openings defined by the inner region of the platform that permit the hinges and the attached strap to be flexed upwardly above the plane of the platform and provide access to the strap.

Also according to the present invention, a container carrier is provided for use with a plurality of containers. The container carrier comprises a substantially planar flexible platform having a top, a bottom, an outer perimeter and an inner region. The inner region of the platform includes a handle and a plurality of container-engaging portions. The handle comprises a strap having a first strap end and a second strap end and first and second hinges integral with the platform. The strap connects to the platform at the first strap end by the first hinge and at the second strap end by the second hinge, each of the strap and first and second hinges being adjacent to openings defined by the inner region of the platform that permit the hinges and the attached strap to be flexed upwardly above the plane of the platform and provide access to the strap. A plurality of container-engaging portions integral with the inner region of the platform are provided. Each container-engaging portion defines an opening through the platform and has a plurality of spaced notches extending radially outwardly of the perimeter of the container-engaging opening forming a plurality of collars for releasably engaging the containers.

Still further according to the present invention, a method of manufacturing is provided for a container carrier for use with a plurality of containers. The method comprises the steps of providing a substantially planar sheet of flexible material having a central axis and a perimeter, forming two generally triangularly shaped openings through the sheet on opposite sides of and equally distant from the central axis of the sheet, the material between the openings comprising a strap having a first end and a second end. Two inwardly opening U-shaped openings are formed through the sheet and around the ends of the strap such that the central axis of the sheet is the line of symmetry of the U-shaped openings. The portion of the sheet bordered by the U-shaped openings comprises a first hinge and a second hinge integral with the first end and second end of the strap, respectively. An equal number of container engaging openings are formed through the sheet of material on opposite ends of the strap, each container engaging opening having a plurality of spaced notches extending radially outward from the perimeter of the opening for forming a plurality of collars. Voids are formed in the perimeter of the sheet between the container engaging openings.

Yet further according to the present invention, a method for manufacturing a handle for a container carrier is provided. The method comprises the steps of providing a substantially planar sheet of flexible material having a central axis, forming two generally triangularly shaped openings through the sheet on opposite sides of and equally distant from the central axis of the sheet, the material between the openings comprising a strap having a first end and a second end, and forming two inwardly opening U-shaped openings through the sheet and around the ends of the strap such that the central axis of the sheet is the line of symmetry of the U-shaped openings, the portion of the sheet bordered by the U-shaped openings comprising a first hinge and a second hinge integral with the first end and second end of the strap, respectively.

DRAWINGS

For a more complete understanding of the present invention, reference should now be had to the embodiments shown in the accompanying drawings and described below. In the drawings.

DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGS. Indeed, the components may be oriented in any direction and the terminology, therefore, should be understood as encompassing such variations unless specified otherwise.

Figure 1:
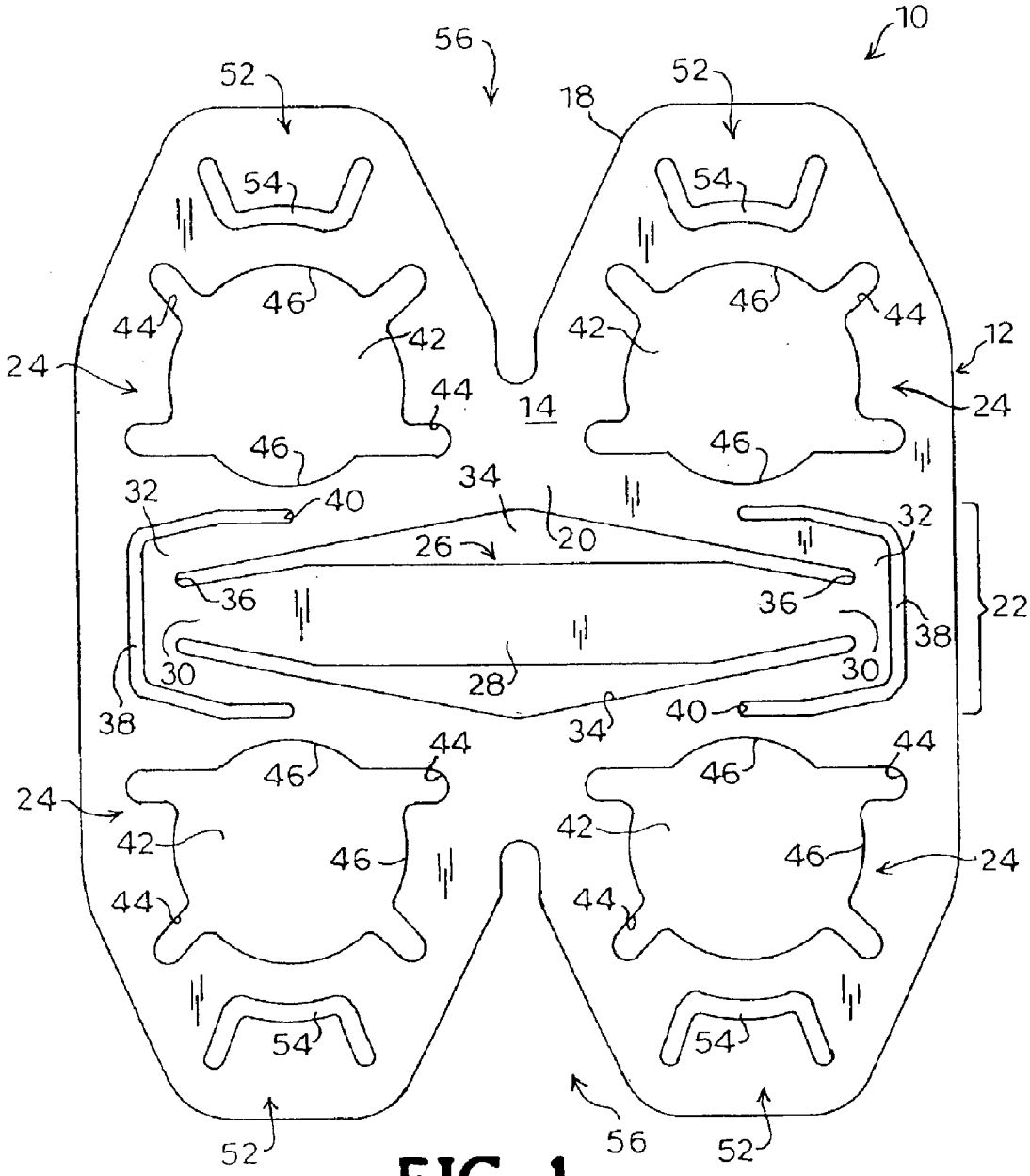
FIG. 1 is a top plan view of an embodiment of a container carrier according to the present invention.

Referring now to the drawings, wherein like reference numerals designate corresponding or similar elements throughout the several views, an embodiment of a container carrier according to the present invention is shown in FIG. 1 and generally designated at 10. The carrier 10 is composed of a thin substantially planar flexible platform 12. The platform 12 has a top surface 14, a bottom surface 16 (not visible in FIG. 1), an outer perimeter 18 and an inner region 20. A handle 22 and a plurality of container-engaging portions 24 are formed in the inner region 20 of the platform 12.

The platform is preferably comprised of a synthetic polymer. Suitable synthetic polymers are those that are tear resistant, relatively rigid, flexible and relatively easy to perforate, including but not limited to, polycarbonate, polyethylene (PET), high density polyethylene (HDPE), nylon polymers (i.e. polyamides) and the like. Nevertheless, the carrier 10 can be constructed using a wide variety of materials. It is understood that the scope of the invention is not intended to be limited by the materials herein, but may be carried out using any materials that allow the construction and use of the described carrier 10.

Figure 2:
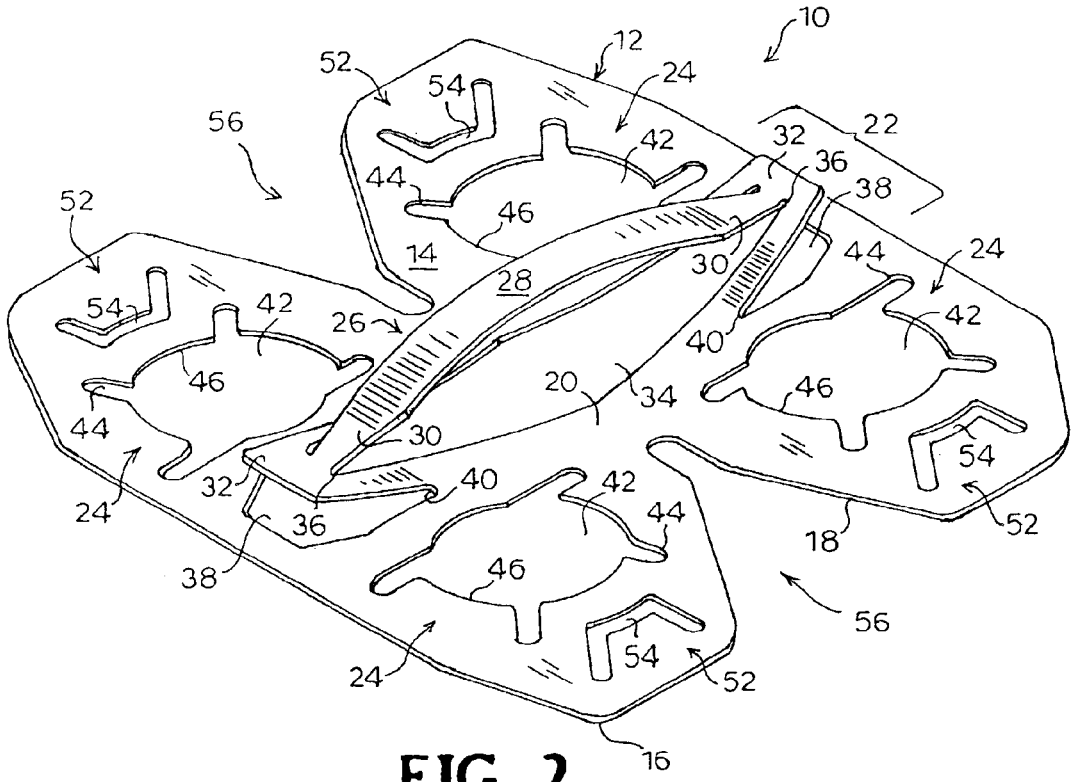
FIG. 2 is a perspective view of the container carrier shown in FIG. 1 demonstrating a flexible strap and hinges.

Referring to FIGS. 1 and 2, the handle 22 comprises a strap 26 integral with the inner region 20 of the platform 12. The strap 26 has a wider intermediate portion 28 and tapers inwardly as it approaches the ends 30 of the strap 26. The ends 30 of the strap 26 attach to hinges 32 formed in the platform 12.

The strap 26 is formed by providing identically shaped openings 34 through the inner region 20 of the platform 20 on opposite sides of, and equally spaced from, the longitudinal midpoint of the platform 20. The openings 34 extend nearly the full width of the platform 20 and are generally triangular in shape, with the intermediate portion of each of the strap openings 34 being wide enough to provide finger access to the strap 26. The openings 34 narrow as they approach the junction of the strap ends 30 and the hinges 32 and the ends 36 of the openings 34 are outwardly radiused. The outwardly radiused ends 36 provide for a slight curvature of the strap ends 30 where they attach to the hinges 32 and help distribute forces exerted upon the strap 26 and prevent tearing where the strap ends 30 attach to the hinges 32.

The hinges 32 are formed by providing inwardly directed U-shaped openings 38 through the platform 12 which surround the strap ends 30 such that the hinges 32 themselves are U-shaped. The ends 40 of the U-shaped openings 38 are radiused outward and provide for a slight curvature of the hinges 32 where they attach to the inner region 20 of the platform 12. This configuration helps distribute forces exerted upon the hinges 32 and prevents tearing where the hinges 32 attach to the inner region 20 of the platform 12.

As shown in FIG. 1, the plurality of opposed container-engaging portions 24 integral with the inner region 20 of the platform 12 are formed on opposite sides of the handle 22. Each container-engaging portion 24 defines a circular opening 42 through the platform 12. Notches 44 are formed in the platform 12 which extend outwardly from the edges of the container-engaging openings 42. The notches 44 form a plurality of flexible collars 46 which serve to engage the containers 48, as will be described below. Although the FIGS. show four collars 46 associated with each container engaging portion 24, it is understood that a greater or lesser number of collars 46 could be used in accordance with the present invention. Adjacent to each container-engaging portion 24 is a tab 52 formed by providing an outwardly directed bow-shaped opening 54 through the platform 12 at a position spaced outwardly from each container-engaging portion 24.

The container-engaging portions 24 on each side of the handle 22 are separated from each other by voids 56 defined by the outer perimeter 18 of the platform 12. The voids 56 permit the shape of the container-engaging portions 24 to flexibly conform to the containers 48 as necessary to accept the load.

Figure 3:
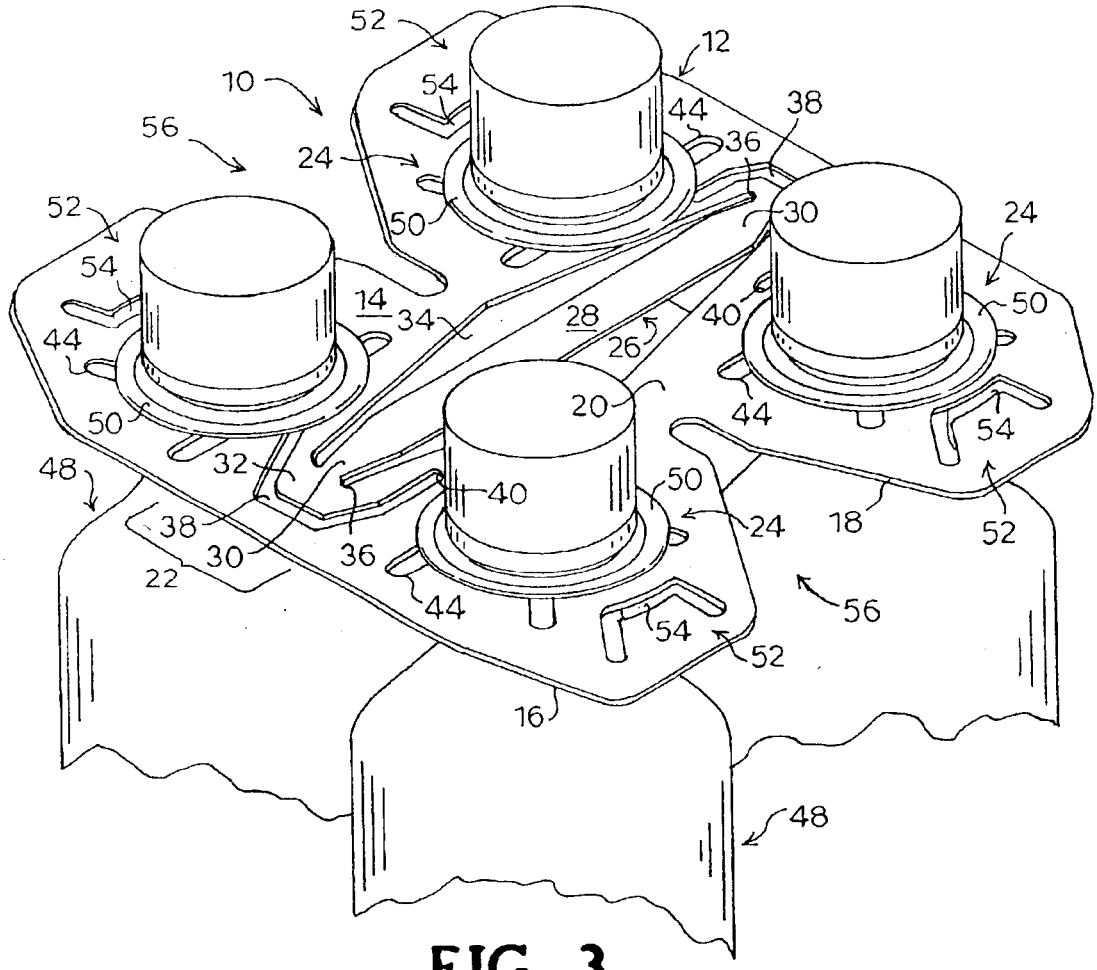
FIG. 3 is a perspective view of a plurality of containers secured in the container carrier shown in FIG. 1.
Figure 4:
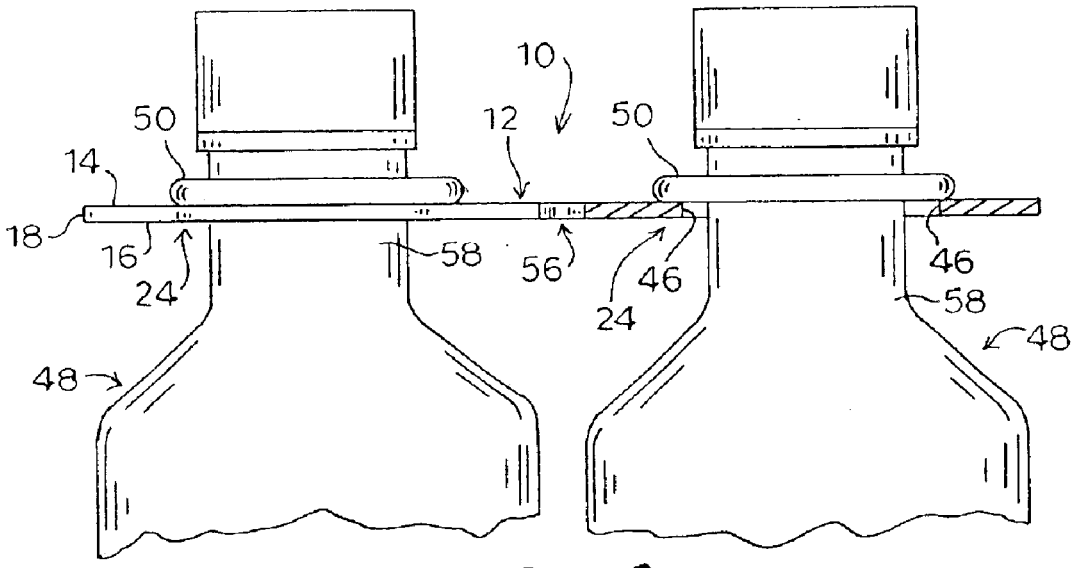
FIG. 4 is a partial cross section of the container carrier and containers shown in FIG. 3.

Referring now to FIG. 3, the container carrier 10 of the present invention is installed onto containers 48 to be packaged by placing the carrier 10 over the containers 48 so that the openings 42 of the container engaging portions 24 are aligned with the necks 58 of the containers 48. The carrier 10 is then forced downwardly onto the containers 48 such that the necks 58 of the containers 48 pass through the openings 42 in the container-engaging portions 24. The notches 44 between the collars 46 facilitate the flexing and spreading of the collars 46 during the insertion of the necks 58 of the containers 48 into the openings 42. The carrier 10 is advanced onto the containers 48 until the collars 46 of the container-engaging portions 24 engage the necks 58 of the containers 48 underneath the enlarged rims 50 of the container necks 58 for securely holding the containers 48 in the carrier 10 (FIG. 4). In keeping with the present invention, the container carrier 10 can be installed on the containers 48 by hand via a manual loader, such as a Manual Carrier Applicator available from Roberts PolyPro, Inc. of Charlotte, N.C. Alternatively, because the flat form of the carrier 10 allows for numerous carriers 10 to be unitized in stacks, automated loading machines such as an Automatic Carrier Applicator, also sold by Roberts PolyPro, Inc., can be used for uniform high-speed installation of the carriers 10.

Once the carrier 10 is installed on the containers 48, the user may transport the carrier 10 and the containers 48 as a package. The user inserts her fingers through the openings 34 adjacent the strap 26, grips the strap 26 and pulls upward. When the strap 26 is engaged, the U-shaped openings 38 adjacent to the hinges 32 permit the hinges 32 and the strap 26 attached thereto to flex upwardly above the plane of the platform 12 (as seen in FIG. 2) such that the user is able to easily fit her hand between the strap 26 and the platform 12 as she grips the strap 26. When the user's grip on the strap 26 is released, the strap 26 resumes its recessed profile and returns to the position of being flush with the platform 12.

Figure 5:
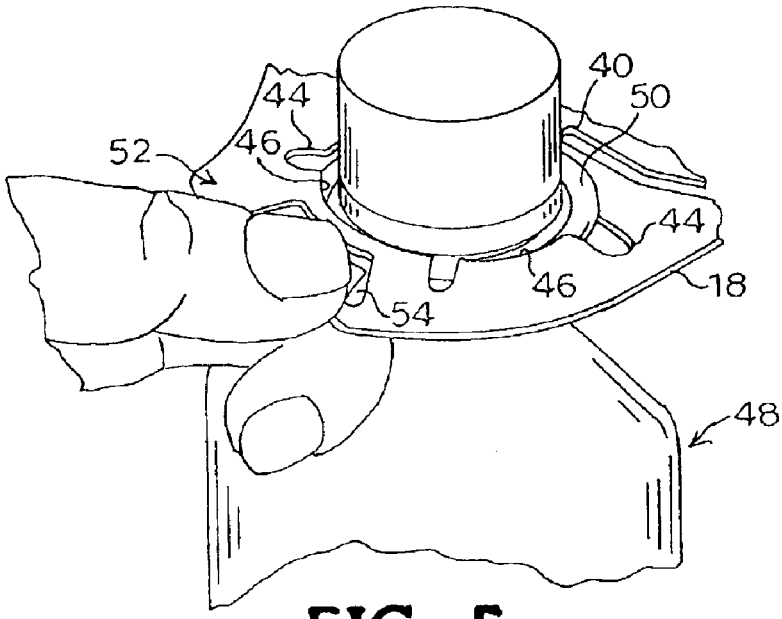
FIG. 5 is a perspective view of a portion of the container carrier shown in FIG. 3 demonstrating a flexible tab for releasing a container from the carrier.

As seen in FIG. 5, to remove a container 48 from the carrier 10, the user grasps the tab 52 adjacent to the container-engaging portion 24 holding the container 48 and pulls upwardly disengaging the collars 46 from underneath the rims 50 of the container necks 58 and lifting the carrier 10 over the neck 58 of the container 48. The bow shaped opening 54 through the platform permits the tab 52 to flex upward when lifted. The notches 44 between the collars 46 allow the collars 46 to flex and spread for disengaging the carrier 10 from the container 48.

It is contemplated that, in one embodiment, the container carrier 10 of the present invention will carry elongated containers 48, such as the bottles shown in FIGS. 3–5. Nevertheless, it is understood that cans, jars, spray bottles, oil containers and other types of containers or packages may be used in connection with the present invention. In addition, although a four-container carrier is illustrated in the FIGS., the carrier 10 according to the present invention can be adapted to carry any number of containers 48. It is preferred, however, that an equal number of container-engaging portions are provided on each side of the handle. The container engaging portions 24 are preferably spaced within the inner region 20 of the platform 12 such that the containers 48 to be held thereby are in relatively close proximity to each other to provide lateral support to each other. Consequently, although the carrier 10 of the present invention can be adapted to carry numerous different sizes and shapes of containers 48, it is preferred that the containers 48 held by a particular carrier 10 are similarly sized.

The container carrier 10 of the present invention can be manufactured by numerous methods known to those skilled in the art. In one embodiment of the present invention, the container carrier 10 may be manufactured utilizing a punch and die set to form the carrier 10 from a substantially planar sheet of polymeric material. This method includes the steps of providing a sheet of polymeric material to a punch and die set, punching openings through the sheet of material to form the handle 22 and the container-engaging portions 24, punching the sheet to define the outer perimeter 18 of the carrier 10, and severing the carrier 10 from the sheet of material. A first die is preferably shaped so that one stroke forms the openings 34 of the handle 22 adjacent the strap 26, the two U-shaped openings 38 adjacent to the flexible hinges 32, the circular openings 42 and notches 44 of the container engaging portions 24, and the bow-shaped openings 54 through the tabs 52. A second die is shaped so that one stroke forms the voids 56 between the container-engaging portions 24 and the outer perimeter 18 of the carrier 10 and severs the carrier 10 from the sheet of polymeric material.

A steel rule die cutter could also be used. The punch and die set is preferred, however, since the punch and die set allows for smaller, more precise cuts to be made in the platform material in order to form the strap and hinge openings 34, 38 according to the present invention. In particular, the use of a punch and die set allows for the openings 34, 38 forming the handle 22 to be cut with outwardly radiused ends 36, 40 and for the strap openings 34 to taper inwardly as they approach the junction of the strap ends 30 and the hinges 32. As described above, this aids in distributing the forces exerted upon the handle 22 during use, and helps prevent tearing at the ends 36, 40 of the openings 34, 38 where the strap ends 30 attach to the hinges 32 and the hinges 32 attach to the inner region 20 of the platform 12.

The container carrier 10 according to the present invention has many advantages, including a flexible handle 22 comprising a strap 26 attached to upwardly flexing hinges 32 which allow for the carrier 10 to be comfortably transported. The wide intermediate portion 28 of the strap 26 provides a large surface area over which the weight of the containers 48 held by the carrier 10 can be spread in the user's hand. Moreover, the upward flexibility of the strap 26 provides sufficient space between the strap 26 and the carrier 10 for the user to easily grip the strap 26 with her hand.

The flat, thin profile of the container carrier 10 of the present invention allows for numerous carriers 10 to be unitized into stacks, packaged for shipping, and efficiently installed on containers 48. In addition, because the handle 22 remains flush with the platform 12 when not transporting containers 48, the thin profile of the carrier 10 does not interfere with the stacking and shipping of the packaged containers 48. Moreover, if the handle 22 is engaged or used by a shipper or retail handler, the handle 22 will readily resume its original recessed position to facilitate stacking. Further, because the handle 22 resumes its substantially flat profile after repeated use, an individual carrier 10 may be re-used indefinitely.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, although the openings of the container engaging portions are illustrated as generally circular in shape, it is understood that the openings may be any shape necessary to accommodate a particular container to be packaged. Accordingly, we intend to cover all such modifications, omissions, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A container carrier for use with a plurality of containers, the carrier comprising:

a substantially planar flexible platform, the platform having a top, a bottom, an outer perimeter and an inner region, the inner region of the platform including a handle comprising a strap having a first strap end and a second strap end, and first and second hinges integral with the inner region of the platform, wherein the strap connects to the platform at the first strap end by the first hinge and at the second strap end by the second hinge, each of the strap and first and second hinges being adjacent to openings defined by the inner region of the platform that permit the hinges and the attached strap to be flexed upwardly above the plane of the platform and provide access to the strap; and a plurality of container-engaging portions integral with the inner region of the platform, each container-engaging portion defining an opening through the platform and having a plurality of spaced notches extending radially outwardly of the perimeter of the container-engaging opening forming a plurality of collars for releasably engaging the containers.

2. A container carrier as recited in claim 1, wherein the width of the strap tapers inwardly adjacent each of the strap ends.

3. A container carrier as recited in claim 1, wherein the openings adjacent the strap are generally triangular in shape and extend the length of the strap.

4. A container carrier as recited in claim 1, wherein the openings adjacent the hinges are U-shaped and border the strap ends.

5. A container carrier as recited in claim 3, wherein the platform adjacent the strap ends defines a slight curvature at the ends of the openings.

6. A container carrier as recited in claim 4, wherein the platform adjacent the first and second hinges defines a slight curvature at the ends of the U-shaped openings.

7. A container carrier as recited in claim 1, wherein the container engaging portions are separated by voids defined by the outer perimeter of the platform.

8. A container carrier as recited in claim 1, further comprising a tab adjacent to each container-engaging portion to aid in the removal of containers held by the carrier.

9. A container carrier as recited in claim 8, wherein each tab defines a bow shaped opening through the platform to permit the tab to flex upward when lifted.

10. A container carrier as recited in claim 1, wherein the container-engaging portions are longitudinally spaced on opposite sides of the longitudinal axis of the handle.

11. A container carrier as recited in claim 1, wherein there are an equal number of container-engaging portions on each side of the handle.

12. A container carrier as recited in claim 1, wherein the platform is composed of a polymeric material.

13. A container carrier as recited in claim 12, wherein the polymeric material is selected from the group consisting of polycarbonate, polyethylene (PET), high density polyethylene (HDPE), and nylon polymer.

14. A handle for a container carrier comprising a substantially planar flexible platform having a top, a bottom, an outer perimeter and an inner region and providing a surface for integrating the handle with a plurality of container-engaging portions, the handle comprising:

a strap having a first strap end and a second strap end, wherein the width of the strap tapers inwardly adjacent each of the strap ends; and first and second hinges adapted to be integral with the platform, the strap connected at the first strap end by the first hinge and at the second strap end by the second hinge, each of the strap and first and second hinges being adjacent to openings defined by the inner region of the platform that permit the hinges and the attached strap to be flexed upwardly above the plane of the platform and provide access to the strap.

15. A handle for a container carrier as recited in claim 14, wherein the hinges are U-shaped.

16. A handle for a container carrier as recited in claim 14, wherein the handle is composed of a polymeric material.

17. A handle for a container carrier as recited in claim 16, wherein the polymeric material is selected from the group consisting of polycarbonate, polyethylene (PET), high density polyethylene (HDPE), and nylon polymer.

18. A method for manufacturing a container carrier for use with a plurality of containers, the method comprising the steps of:

providing a substantially planar sheet of flexible material having a central axis and a perimeter;

forming two generally triangularly shaped openings through the sheet on opposite sides of and equally distant from the central axis of the sheet, the material between the openings comprising a strap having a first end and a second end;

forming two inwardly opening U-shaped openings through the sheet and around the ends of the strap such that the central axis of the sheet is the line of symmetry of the U-shaped openings, the portion of the sheet bordered by the U-shaped openings comprising a first hinge and a second hinge integral with the first end and second end of the strap, respectively;

forming an equal number of container engaging openings through the sheet of material on opposite sides of the strap, each container engaging opening having a plurality of spaced notches extending radially outward from the perimeter of the opening for forming a plurality of collars; and forming voids in the perimeter of the sheet between the container engaging openings.

19. A container carrier manufacturing method as recited in claim 18, further comprising the step of forming a bow shaped opening through the sheet of material adjacent to each container engaging opening, the portion of the sheet adjacent to each bow shaped opening forming a flexible tab.

20. A container carrier produced in accordance with the process of claim 18.

21. A method for manufacturing a handle for a container carrier, the method comprising the steps of:

providing a substantially planar sheet of flexible material having a central axis;

forming two generally triangularly shaped openings through the sheet on opposite sides of and equally distant from the central axis of the sheet, the material between the openings comprising a strap having a first end and a second end, the width of the strap tapering inwardly adjacent each of the strap ends; and forming two inwardly opening U-shaped openings through the sheet and around the ends of the strap such that the central axis of the sheet is the line of symmetry of the U-shaped openings, the portion of the sheet bordered by the U-shaped openings comprising a first hinge and a second hinge integral with the first end and second end of the strap, respectively.

22. A handle produced in accordance with the process of claim 21.

23. A container carrier for use with a plurality of containers, the carrier comprising:

a substantially planar flexible platform, the platform having a top, a bottom, an outer perimeter and an inner region, the inner region of the platform including a handle comprising a strap having a first strap end and a second strap end, and first and second hinges integral with the inner region of the platform, wherein the strap connects to the platform at the first strap end by the first hinge and at the second strap end by the second hinge, each of the strap and first and second hinges being adjacent to openings defined by the inner region of the platform that permit the hinges and the attached strap to be flexed upwardly above the plane of the platform and provide access to the strap; and a plurality of container-engaging portions integral with the inner region of the platform, each container-engaging portion defining an opening through the platform and having a plurality of spaced notches extending outwardly of the perimeter of the container-engaging opening forming a plurality of collars for releasably engaging the containers.

24. A method for manufacturing a container carrier for use with a plurality of containers, the method comprising the steps of:

providing a substantially planar sheet of flexible material having a central axis and a perimeter;

forming two generally triangularly shaped openings through the sheet on opposite sides of and equally distant from the central axis of the sheet, the material between the openings comprising a strap having a first end and a second end;

forming two inwardly opening U-shaped openings through the sheet and around the ends of the strap such that the central axis of the sheet is the line of symmetry of the U-shaped openings, the portion of the sheet bordered by the U-shaped openings comprising a first hinge and a second hinge integral with the first end and second end of the strap, respectively; and forming an equal number of container engaging openings through the sheet of material on opposite sides of the strap, each container engaging opening having a plurality of spaced notches extending outwardly from the perimeter of the opening for forming a plurality of collars.

* * * * *